US007784481B2

(12) United States Patent
Kunkel

(10) Patent No.: US 7,784,481 B2
(45) Date of Patent: Aug. 31, 2010

(54) ACTUATING DEVICE FOR FIXTURES AND METHOD FOR THE OPERATION THEREOF

(75) Inventor: Horst Kunkel, Stuttgart (DE)

(73) Assignee: Hansa Metallwerke AG, Stuttgart (DE)

( * ) Notice: Subject to any disclaimer, the term of this patent is extended or adjusted under 35 U.S.C. 154(b) by 625 days.

(21) Appl. No.: 11/660,229

(22) PCT Filed: Aug. 16, 2005

(86) PCT No.: PCT/EP2005/008883

§ 371 (c)(1),
(2), (4) Date: Aug. 22, 2007

(87) PCT Pub. No.: WO2006/018275

PCT Pub. Date: Feb. 23, 2006

(65) Prior Publication Data

US 2008/0128645 A1 Jun. 5, 2008

(30) Foreign Application Priority Data

Aug. 18, 2004 (DE) ..... 10 2004 039 917

(51) Int. Cl.
*F16K 31/02* (2006.01)

(52) U.S. Cl. ..... 137/1; 137/624.11; 251/129.04; 4/623

(58) Field of Classification Search ..... 137/624.11, 137/1; 251/129.04; 4/623
See application file for complete search history.

(56) References Cited

U.S. PATENT DOCUMENTS

| | | | | |
|---|---|---|---|---|
| 5,961,095 | A | 10/1999 | Schrott | |
| 6,513,787 | B1 * | 2/2003 | Jeromson et al. | 251/129.04 |
| 2005/0133100 | A1 | 6/2005 | Bolderheij | |

FOREIGN PATENT DOCUMENTS

| | | | |
|---|---|---|---|
| DE | 3 812 736 | C1 | 11/1989 |
| DE | 35 15 640 | C2 | 8/1993 |
| DE | 295 05 470 | U1 | 12/1995 |
| DE | 296 04 826 | U1 | 8/1996 |
| DE | 195 39 879 | A1 | 4/1997 |
| DE | 201 15 097 | U1 | 3/2002 |
| DE | 103 32 708 | B3 | 1/2005 |
| EP | 1 362 960 | A1 | 11/2003 |

* cited by examiner

*Primary Examiner*—Kevin L Lee
(74) *Attorney, Agent, or Firm*—Factor & Lake, Ltd.

(57) ABSTRACT

Disclosed is an actuating device for fixtures, particularly plumbing fixtures, comprising at least one input unit that is provided with a plurality of sensors which are connected to a control unit, and at least one drive unit for at least one closing device for at least one fluid pipe, especially a valve of a water pipe that can be controlled by means of the control unit. At least three sensors are arranged in a substantially regular manner essentially along a closed curve. The drive unit is triggered when signals of at least two adjacent sensors are detected.

24 Claims, 3 Drawing Sheets

ACTUATING DEVICE FOR FIXTURES AND METHOD FOR THE OPERATION THEREOF

RELATED APPLICATIONS

This application claims the filing benefit of International PCT Patent Application PCT/EP2005/008883, filed Aug. 16, 2005; which claims the filing benefit of German Patent Application DE 102004039917.4, filed Aug. 18, 2004; of which the contents of these applications are incorporated herein by reference.

TECHNICAL FIELD

The invention relates to an actuating device for fixtures, in particular for sanitary fixtures, having at least one input unit, which comprises a plurality of sensors that are connected to a control unit, and at least one drive unit for at least one shut-off device for at least one fluid pipe, in particular for a valve of a water pipe controllable by the control unit.

The invention further relates to a method of operating an actuating device for fixtures, in particular for sanitary fixtures, whereby in dependence upon sensor signals at least one drive unit for a shut-off device of a fluid pipe, in particular for a valve of a water pipe, is activated.

BACKGROUND OF THE INVENTION

Actuating devices of the initially described type are used in particular to set a water temperature and/or a volumetric flow of water in sanitary facilities.

From DE 19539879 A1 it is known to use three contact-free sensors or a membrane keyboard to request a water flow, set the volumetric flow of the water and select the water temperature. In this case, each sensor is assigned a function. To vary the water temperature and the volumetric flow of the water, the appropriate sensor has to either be actuated a plurality of times or remain actuated.

DE 29505470 U1 proposes by means of a single actuation of a press point within an analogue operator panel with a two-dimensional X-Y arrangement to effect a simultaneous analogue setting of volumetric flow and temperature. Here, if an incorrect press point is inadvertently actuated, this may lead to an undesirable, possibly very large change in the temperature or the volumetric flow. An operator error with serious consequences cannot therefore be ruled out here. In order to allow fine graduation, such a device moreover requires a correspondingly large operator panel.

In other fixtures of the initially described type, control is effected by means of a direct digital numerical input. This poses problems in particular for persons who have difficulty reading numbers, especially preschool children or the visually impaired, with the result that, in this case too, operator errors cannot be ruled out.

The present invention is directed to solving these and other matters.

SUMMARY OF THE INVENTION

An object of the present invention is to develop a device and a method of the initially described type in a way that allows a simple and reliable continuous change of fluid volumetric flows and/or fluid temperatures. Furthermore, the device is to be space-saving and capable of realization without a high technical outlay. The device is moreover to be as maintenance-free as possible and to be operated with low wear.

This object can be achieved according to the present invention in that at least three sensors are disposed so as to be distributed substantially uniformly substantially along a closed curve. More specifically, an actuating device for a fixture, having at least one input unit, which comprises a plurality of sensors that are connected to a control unit, and at least one drive unit for at least one shut-off device for at least one fluid pipe, wherein at least three of the plurality of sensors are disposed so as to be substantially uniformly distributed substantially along a closed curve.

According to the present invention, a parameter for the shut-off device that specifies in particular a valve lift of the valve is varied by means of three sensors. By means of the shut-off device either a mixing ratio of cold and hot fluid, in particular water, may be varied, in order to vary the temperature of the fluid mixture, or a volumetric flow of the fluid may be set. To effect a variation of the parameter, at least two adjacent sensors have to be actuated in succession. This is done by sweeping over the sensors, it being immaterial which sensor is swept over first. As the sensors are disposed along a closed curve, it is possible to start at any desired point of the curve. Depending on the order in which the sensors are actuated, i.e. depending on the direction in which the curve is followed, the parameter in increased or decreased. There is therefore no need to inscribe the sensors. Furthermore, an extreme variation as a result of inadvertent actuation of an incorrect sensor is not possible. The arrangement of the three sensors along a closed curve is moreover extremely space-saving.

In an advantageous form of construction, the control unit comprises a decrementer/incrementer, by means of which the parameter may be increased and decreased respectively. A decrementer/incrementer may be realized without a high technical outlay, for example through programming of the control unit.

In a further advantageous form of construction, the control unit advantageously comprises a timer, by means of which a time interval may be specified, within which two sensor signals are identified as belonging together, i.e. an intentional actuation of the actuating device by a user.

In a further advantageous form of construction, the sensors are actuable in a particularly simple manner, even for children and the elderly, by being swept over in particular by at least one finger.

Particularly when used as part of a shower fixture, the actuating device is exposed to a water stream and hence optionally to temperature variations. A first, particularly advantageous form of construction therefore provides tactile sensors, which have the advantage of being substantially insusceptible to temperature variations.

Here, preferential use is made of capacitive sensors, which are actuable without pressure.

In other area of application it is particularly undesirable to touch the actuating device for example with dirty hands. For this eventuality, an alternative advantageous form of construction provides proximity-type sensors, which are also actuable without direct contact.

Here, infrared sensors are preferably provided, which may be realized particularly easily and without a high technical outlay.

To allow reliable actuation of the actuating device also in the event of impaired vision of the user, for example if the user under the shower has soap in his eyes or in poor light conditions, a particularly advantageous form of construction provides that the sensors are disposed along a guide device for in particular at least one finger, so that blind operation of the actuating device is also possible.

A particularly advantageous form of construction provides a dial, which has at least one operator control, in particular a finger depression. This markedly increases the operating comfort especially for users who prefer a quasi-mechanical actuating device.

In an advantageous form of construction, the operator control is assignable to the sensors, thereby allowing actuation of the sensors with a finger. For example, the operator control may be a through-hole in the dial, in which during a rotation of the dial the finger is guidable along the sensors. In this way, both proximity-type and tactile sensors are actuable directly by means of the finger.

In an advantageous form of construction, the dial has at least one magnet, which by rotation of the dial is guidable along the sensors realized in the form of field probes. Magnets have the advantage that they may be integrated in the dial, i.e. disposed in an encapsulated manner, so as that they are invisible from the outside and also protected from ambient influences, in particular from heat and moisture. The field probes may likewise be disposed in an encapsulated manner. Here, the positioning of the operator control relative to the sensors is immaterial because the actuation of the sensors is effected, not directly by the finger, but by the magnet.

Where magnetic fields are undesirable, another advantageous form of construction provides that the dial has at least one mirror element, which by rotation of the dial is guidable along the sensors realized in the form of reflex sensors. The light emitted by the respective reflex sensor is reflected by the mirror element as soon as the mirror element is guided past the reflex sensor. Here too, as in the form of construction having the magnet/field probe combination, the positioning of the operator control relative to the sensors is immaterial.

It is particularly advantageous to connect at least two sensors in parallel in order to allow a faster variations of the parameter. Thus, the number of sensors may be increased to allow even more precise actuation without any need for additional evaluation inputs at the control unit and signal lines.

In a further advantageous form of construction, along at least two closed curves, in particular two concentric circles, in each case at least three sensors are disposed, by means of which different operating parameters, in particular the water quantity and the water temperature, are variable. This has the advantage that two different operating parameters are therefore variable independently of one another. In dependence upon the sensor signals, corresponding shut-off devices, in particular a hot-water valve in a hot-water pipe and a cold-water valve in a cold-water pipe, may then be opened and/or closed by the control unit.

In the method according to the invention, the activation is effected when signals are acquired from at least two adjacent sensors of at least three sensors disposed substantially along a closed curve. In this way, an activation in the event of inadvertent actuation of only one of the sensors is extensively avoided. Furthermore, from the order in which the at least two adjacent sensors are actuated it may be determined whether the shut-off devices is to be opened or closed.

In order to open or close the shut-off device, in an advantageous development of the method, depending on the order of the two signals and the position of the corresponding sensors relative to one another, a parameter that specifies in particular the valve lift of the valve is decremented and/or incremented. The drive unit is then activated accordingly.

In a particularly advantageous development of the method, the sensors are cyclically scanned, so that the parameter may be repeatedly decremented and/or incremented until a valve lift is set, which specifies a desired fluid temperature and/or a desired fluid volumetric flow.

An advantageous development provides that, in the event of repeat acquisition of a signal from the same sensor, a previous decrementing and/or incrementing operation is negated in order to undo a variation of the parameters.

In a further advantageous development of the method, the activation is effected only when the signals of the at least two adjacent sensors are acquired within a specified time interval.

It is to be understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
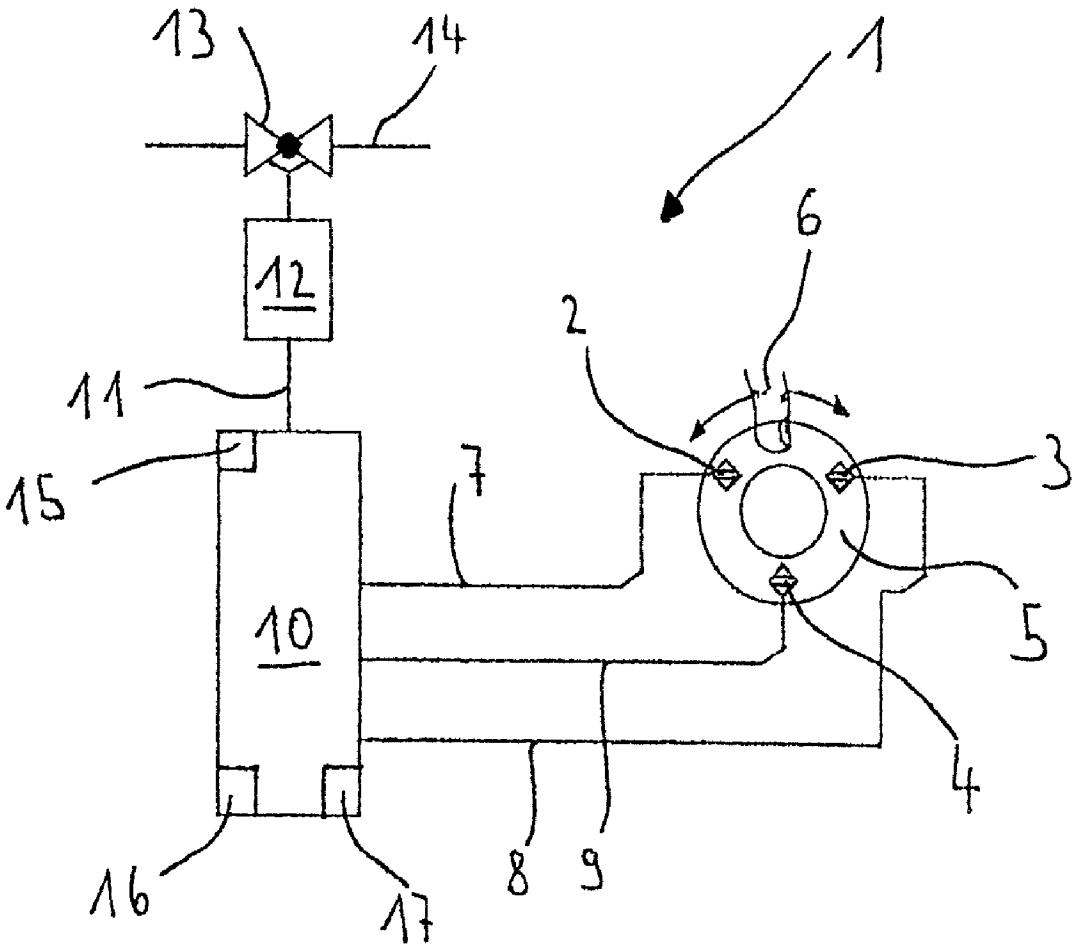
FIG. 1 is a diagram depicting a first embodiment of an actuating device for a sanitary fixture.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

FIG. 1 shows a first embodiment of the invention. The actuating device, which is provided as a whole with the reference character 1, for a sanitary fixture comprises three sensors 2, 3, 4, which each form one corner of an imaginary equilateral triangle.

Extending along the sensors 2, 3, 4 is an annular guide depression 5, which is formed in a non-illustrated operator panel. The guide depression 5 is used to guide a finger 6 of a user in the event of actuation of the actuating device 1.

The sensors 2, 3, 4 are connected in each case by a signal line 7, 8, 9 to a control unit 10.

By means of the control unit 10 a drive unit 12 of a valve 13 in a water pipe 14 is controllable via a control line 11.

The control unit 10 comprises a decrementer/incrementer 15, by means of which a parameter specifying a valve lift of the valve 13 may be decremented and/or incremented as soon as corresponding sensor signals are acquired. The control unit 10 moreover comprises a sensor memory 16 for the last-actuated sensor 2, 3, 4. The control unit 10 further comprises a timer 17, which is used to specify a time interval, within which the acquisition of a plurality of sensor signals by the control unit 10 is to be interpreted as an intentional actuation by the user.

In order to open and/or close the valve 13, the finger 6 of the user has to be guided in the appropriate direction along the guide depression 5 past at least two adjacent sensors of the three sensors 2, 3, 4.

Depending on the number of circuits of the finger 6 in the guide depression 5, a degree of opening and/or closing of the valve 13 is effected by the control unit 10. With each circuit, depending on the circuit direction the parameter for the valve lift is incremented and/or decremented threefold and the valve lift is varied accordingly.

Figure 2:
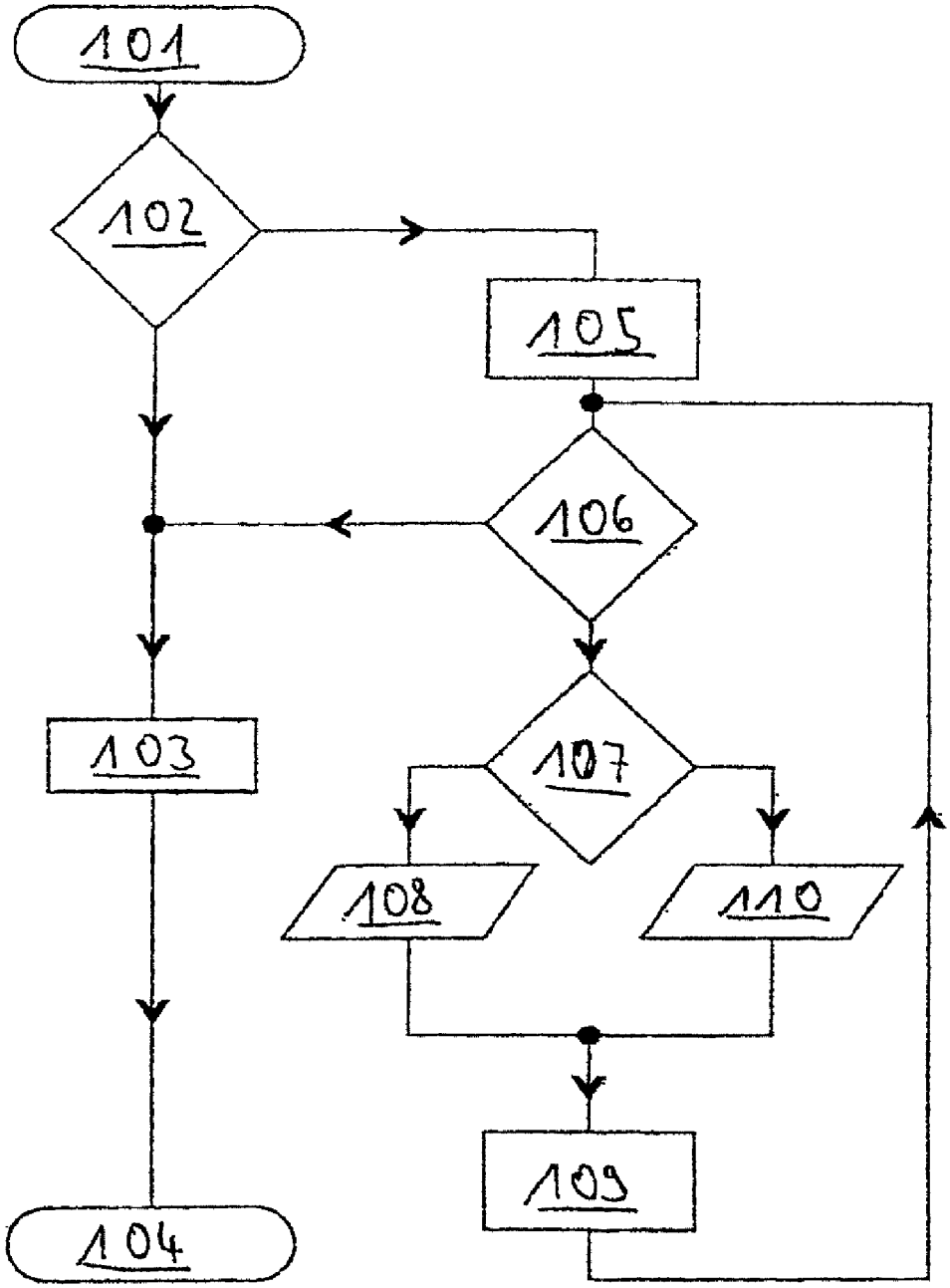
FIG. 2 is a diagram depicting a method of operating the actuating device represented in FIG. 1; and, FIG. 3 is a diagram depicting a second embodiment of an actuating device for a sanitary fixture.

FIG. 2 shows how the actuating device 1 is operated by the control unit 10.

To begin with, a scanning of the sensors 2, 3, 4 by the control unit 10 is started in a method step 101.

In a first checking step 102 it is then checked whether one of the sensors 2, 3, 4 has been actuated. If none of the sensors 2, 3, 4 has been actuated, then in a method step 103 the contents of the sensor memory 16 are deleted. The method is then terminated in a method step 104 and automatically restarted at a later time in an as such known manner, which is not represented, with the method step 101. In this way, the sensors 2, 3, 4 are cyclically scanned.

If, on the other hand, in the first checking step 102 it is detected that one of the sensors 2, 3, 4 has been actuated, then in a method step 105 the identification of this sensor 2, 3, 4 are stored in the sensor memory 16 and a time loop of the length specified by the timer 17 (time interval) is started.

Then, in a second checking step 106 it is checked whether within the specified time interval an adjacent sensor 3, 4, 2 has been actuated. If no adjacent sensor 3, 4, 2 has been actuated, then in the method step 103 the sensor memory 16 is deleted and the method is then terminated in the method step 104.

If, on the other hand, in the second checking step 106 it is detected that within the specified time interval a further adjacent sensor 3, 4, 2 has been actuated, then in a third checking step 107 it is checked whether this sensor 3, 4, 2 is disposed in clockwise direction before or after the sensor 2, 3, 4 detected in the first checking step 102.

If it is detected that the second actuated sensor 3, 4, 2 is disposed in clockwise direction before the first actuated sensor 2, 3, 4, then in a method step 108 the parameter for the valve lift is decremented. With this parameter the drive unit 12 is then activated—not represented in FIG. 2—and the valve lift of the valve 13 in reduced in accordance with the decrementing operation.

Then, in a in a method step 109 the identification of the second sensor 3, 4, 2 is stored in the sensor memory 16 and the time loop is repeated from the checking step 106.

If, on the other hand, in the checking step 107 it is detected that the second actuated sensor 3, 4, 2 is disposed in clockwise direction before the first actuated sensor 2, 3, 4, then in a method step 110 the parameter for the valve lift is incremented and the valve lift, as in the method step 108, is accordingly increased. Then, in the method step 109 the identification of the second actuated sensor 2, 3, 4 is stored in the sensor memory 16 and the time loop is repeated likewise from the checking step 106.

The method steps 106 to 109 and/or 110 are cyclically repeated so often, until in the checking step 106 it is detected that within the specified time interval no further sensor has been actuated. In this way, the valve lift is reduced and/or increased in accordance with the number of repeats, i.e. the number of actuations of adjacent sensors 2, 3, 4.

Figure 3:
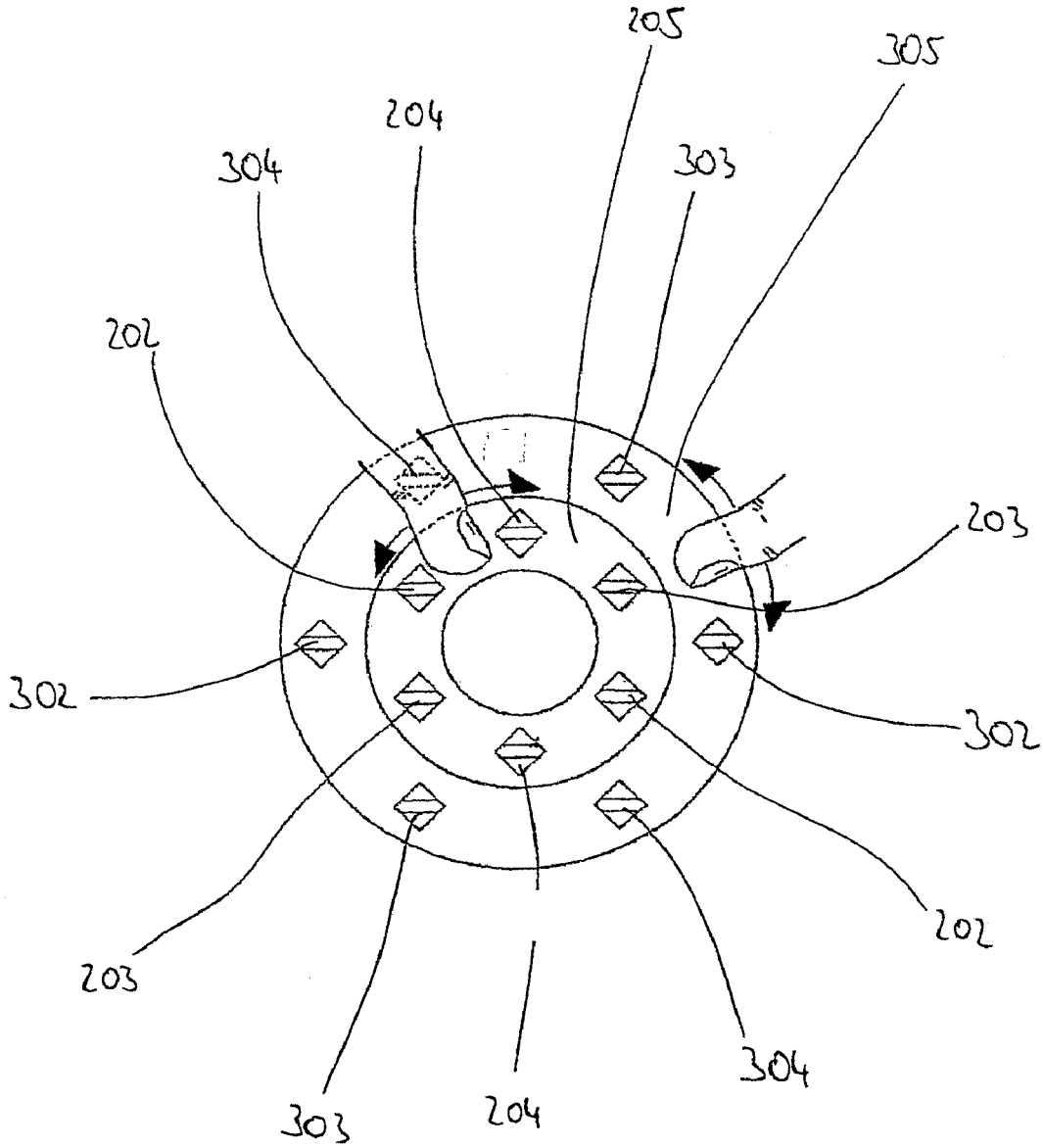

FIG. 3 shows a second embodiment of the invention. The second embodiment differs from the first embodiment represented in FIG. 1 in that, instead of the guide depression 5, two coaxial annular guide depressions 205, 305 are provided.

Disposed along the inner guide depression 205 are three sensor pairs each comprising two opposing sensors 202, 203, 204, by means of which the water quantity may be varied. Disposed along the outer guide depression 305 are three sensor pairs each comprising two sensors 302, 303, 304, by means of which the water temperature may be varied.

The sensors 202, 203, 204, 302, 303, 304 of the respective guide depression 205, 305 form the corners of a corresponding hexagon.

The sensors 202, 203, 204, 302, 303, 304 of each sensor pair are connected in parallel. Each sensor pair is connected by a signal line, which is not represented in FIG. 3, to a non-illustrated control unit as in the first embodiment.

By means of the control unit a first drive unit of a hot-water valve in a hot-water pipe and a second drive unit of a cold-water valve of a cold-water pipe are controllable.

In order to vary the water quantity without varying the water temperature, the sensors 202, 203, 204 along the is inner guide depression 205 are actuated by a finger as in the first embodiment, so that the hot-water valve and the cold-water valve are simultaneously opened and/or closed.

In order to vary the water temperature without varying the water quantity, the sensors 302, 303, 304 along the outer guide depression 305 are actuated, so that the hot-water valve is opened and at the same time the cold-water valve is closed or the hot-water valve is closed and at the same time the cold-water valve is opened.

Instead of the hot-water valve and the cold-water valve in the second embodiment, a single mixing valve may be provided.

Instead of the tactile sensors, it is possible to use other sensors, for example proximity-type sensors, capacitive sensors or infrared sensors.

Instead of the guide depressions 5, 205, 305, in each case a dial having an operator control for a finger may be provided. The dial is mounted rotatably about the centre of the imaginary triangle formed by the sensors. The operator control may be a through-hole, in which the finger is guided along the respective sensors. Given the use of proximity-type sensors, the operator control may be merely a depression, and the sensors detect the presence of the finger through the dial. In this case, however, the operator control has to be disposed in such a way on the dial that during a rotation it is guided closely along the sensors. On the underside of the dial it is also possible to dispose at least one mirror element. By rotation of the dial, the mirror element is guided along the sensors realized in the form of reflex sensors. In this case, the positioning of the operator control relative to the sensors is immaterial which the sensors are actuated, not directly by the finger, but by the mirror element. Instead of the mirror elements, magnets may be provided, with which as field probes as sensors are associated.

It is also possible to provide more than three sensors and/or sensor pairs—the greater the number of sensors, the more quickly a variation of the parameters is possible.

In the method, in the third checking step it may also be provided that the previous incrementing and/or decrementing of the parameter for the valve lift is negated if the same sensor has been actuated twice in succession.

It may moreover also be provided that the valve lift is decremented given a full revolution in clockwise direction and incremented given a full revolution in anticlockwise direction.

It is to be understood that additional embodiments of the high-speed door assembly described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An actuating device for a fixture having at least one input unit, the device comprising:

a plurality of sensors that are connected to a control unit; and, at least one drive unit for at least one shut-off device for at least one fluid pipe, wherein at least three of the plurality of sensors are disposed so as to be substantially uniformly distributed substantially along a closed curve, wherein the control unit is configured such that the control unit detects an order of incoming chronologically successive sensor signals and the control unit conducts changes of a parameter when an actuation of at least two sensors is detected to be chronologically successively, and wherein the control unit determinates from the order of the incoming sensor signals if an increase or a decrease of the parameter is to be made, and provides a signal which acts on the drive unit of the shut-off device.

2. The actuating device of claim 1, wherein the control unit comprises a decrementer/incrementer.

3. The actuating device of claim 1, wherein the control unit comprises a timer.

4. The actuating device of claim 1, wherein the at least three sensors are actuable by being swept over by at least one finger.

5. The actuating device of claim 1, wherein the at least three sensors are tactile sensors.

6. The actuating device of claim 1, wherein the at least three sensors are capacitive sensors.

7. The actuating device of claim 1, wherein the at least three sensors are proximity-type sensors.

8. The actuating device of claim 1, wherein the at least three sensors are infrared sensors.

9. The actuating device of claim 1, wherein the at least three sensors are disposed along a guide device.

10. The actuating device of claim 1, further comprising a dial including an operator control.

11. The actuating device of claim 10, wherein the operator control is assignable to the at least three sensors.

12. The actuating device of claim 10, wherein the dial has at least one magnet, which by rotation of the dial is guidable along the at least three sensors realized in the form of field probes.

13. The actuating device of claim 10, wherein the dial has at least one minor element, which by rotation of the dial is guidable along the at least three sensors realized in the form of reflex sensors.

14. The actuating device of claim 1, wherein at least two of the at least three sensors are connected in parallel.

15. The actuating device of claim 1, wherein the at least three sensors are disposed along each of at least two closed curves, by means of which different operating parameters are variable.

16. A method of operating an actuating device for fixtures, whereby in dependence upon sensor signals at least one drive unit for a shut-off device of a fluid pipe is activated, wherein the activation is effected when signals from at least two adjacent sensors of at least three of a plurality of sensors disposed substantially along a closed curve are acquired.

17. The method according to claim 16, wherein depending on the order of the two signals and the position of the corresponding sensors relative to one another, a parameter that specifies a degree of opening of the shut-off device, is incremented and/or decremented, and then the drive unit is activated accordingly.

18. The method of claim 16, wherein the at least three of the plurality of sensors are cyclically scanned.

19. The method of claim 16, whereupon the event of repeat acquisition of a signal from a same sensor a previous incrementing and/or decrementing operation is negated.

20. The method of claim 16, wherein the activation is effected when the signals of the at least two adjacent sensors are acquired within a specified time interval.

21. An actuating device for a fixture having at least one input unit, which comprises:

a plurality of sensors that are connected to a control unit;

at least one drive unit for at least one shut-off device for at least one fluid pipe; and, a dial including an operator control; and, wherein at least three of the plurality of sensors are disposed so as to be substantially uniformly distributed substantially along a closed curve; and a dial including an operator control.

22. An actuating device for a fixture having at least one input unit, which comprises:

a plurality of sensors that are connected to a control unit;

at least one drive unit for at least one shut-off device for at least one fluid pipe; and, wherein at least three of the plurality of sensors are disposed so as to be substantially uniformly distributed substantially along a closed curve; and a dial including an operator control; and, wherein at least two of the at least three sensors are connected in parallel.

23. An actuating device for a fixture having at least one input unit, which comprises:

a plurality of sensors that are connected to a control unit;

at least one drive unit for at least one shut-off device for at least one fluid pipe; and, wherein at least three of the plurality of sensors are disposed so as to be substantially uniformly distributed substantially along a closed curve; and a dial including an operator control; and, wherein the at least three sensors are disposed along each of at least two closed curves, by means of which different operating parameters are variable.

24. A method of operating an actuating device for fixtures, whereby in dependence upon sensor signals at least one drive unit for a shut-off device of a fluid pipe is activated, wherein the activation is effected when signals from at least two adjacent sensors of at least three of a plurality of sensors disposed substantially along a closed curve are acquired; and, whereupon the event of repeat acquisition of a signal from a same sensor a previous incrementing and/or decrementing operation is negated.

* * * * *